United States Patent [19]

Tamura et al.

[11] Patent Number: 4,910,073

[45] Date of Patent: Mar. 20, 1990

[54] BOWLING LANE AND METHOD OF REPAIRING SAME

[75] Inventors: Hiroshi Tamura, Wakayama; Fumio Yamamoto; Masaichi Kaneko, both of Osaka, all of Japan

[73] Assignee: Danippon Ink and Chemicals, Inc., Tokyo, Japan

[21] Appl. No.: 152,372

[22] Filed: Feb. 4, 1988

[51] Int. Cl.[4] ..... B32B 27/08; B32B 7/02

[52] U.S. Cl. ..... 428/215; 428/203; 428/414; 428/217; 428/423.1; 428/425.1; 428/537.1; D21/233

[58] Field of Search ..... 428/201, 203, 414, 423.1, 428/423.3, 425.1, 537.1, 215, 217; D21/233

[56] References Cited

U.S. PATENT DOCUMENTS 4,013,598 3/1977 Evans et al. ..... 428/413

OTHER PUBLICATIONS

*Encyclopedia of Polymer Science and Technology*, vol. 15, John Wiley and Sons, Inc., N.Y., 1969, p. 471, table 12.

*Primary Examiner*—George F. Lesmes
*Assistant Examiner*—Christopher Brown
*Attorney, Agent, or Firm*—Nixon & Vanderhye

[57] ABSTRACT

A bowling lane is disclosed, which comprises a substrate having provided thereon an epoxy resin layer and a polyurethane resin layer in this order. Also disclosed is a method of repairing a bowling lane, comprising coating a degased epoxy resin on the surface of a substrate of a bowling lane to form an epoxy resin layer and further coating a degased polyurethane resin on the epoxy resin layer.

23 Claims, 1 Drawing Sheet

BOWLING LANE AND METHOD OF REPAIRING SAME

BACKGROUND OF THE INVENTION

This invention relates to bowling lanes having excellent transparency, oil resistance, weatherability (yellowing resistance), abrasion resistance and impact resistance.

Usually, bowling lanes are composed of wood the surface of which is coated with a transparent resin lacquer. However, during repeated use, the surface of the lanes is susceptible to becoming uneven due to collision or friction by balls because they are made of wood, and therefore resurfacing is needed in order to plane or whittle the wood to obtain an even or smooth surface, followed by coating the surface with a lacquer.

The resurfacing is disadvantageous not only because it requires much trouble but also because the lanes will become thinner and thinner after repeated resurfacing, i.e., repeated planing, resulting in the lanes finally becoming too thin to allow further resurfacing so that the lanes have to be replaced with new ones after a certain period of time in which the lanes are in operation for bowling. This approach is not an ultimate solution because providing new lanes is expensive and it takes a long time to replace the lanes with new ones, which means the bowling alley must be closed for a long time during repairs.

Recently, it has been proposed to provide a relatively thick resin coating on the substrate of a lane in order to avoid resurfacing of the lane and make it easier to repair it as described in JP-A-58-109563. Although this process uses a flexible epoxy resin, it suffers not only the occurrence of cracking in the resin coating layer due to the impact of balls during play but also yellowing as a result of prolonged illumination in the bowling alley.

Further proposals have been made as described in Japanese laid open utility model application 62-160987, according to which bowling lanes are coated with a flexible epoxy resin after being coated with a polyurethane resin, and in Japanese laid open utility model application 62-183882, which discloses a bowling lane coated with a polyurethane resin in a thickness not less than 1 mm. However, the bowling lanes described these publications do not meet all of the requirements of transparency, weatherability, impact resistance, abrasion resistance and oil resistance.

SUMMARY OF THE INVENTION

An object of this invention is to provide a bowling lane which is free of the above-described disadvantages and has excellent properties such as transparency, oil resistance, weatherability (yellowing resistance), impact resistance and abrasion resistance, and thus has a long service life.

Another object of this invention is to provide a method of repairing bowling lanes which is easy to carry out and gives the lanes excellent properties as described above.

As a result of intensive investigation, it has now been found that the above objects of this invention can be achieved by providing of a polyurethane coating layer as a top layer on an epoxy resin layer which in turn is coated as an intermediate subbing layer directly on the wood substrate of a bowling lane.

Therefore, this invention provides a bowling lane comprising a substrate having coated thereon an epoxy resin layer and a polyurethane resin layer in this order.

In another aspect, this invention provides a method of repairing a bowling lane, comprising coating a degased epoxy resin on the surface of a substrate of a bowling lane to form an epoxy resin layer and further coating a degased polyurethane resin on the epoxy resin layer.

BRIEF DESCRIPTION OF THE INVENTION

FIGS. 1 and 2 are schematic longitudinal cross-sectional view of a bowling lane comprising a substrate having coated thereon an epoxy resin layer and a polyurethane resin coating layer in this order.

DETAILED DESCRIPTION OF THE INVENTION

Figure 1:
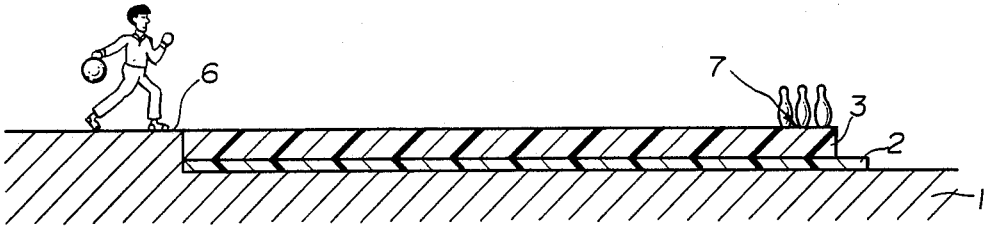

The epoxy resin which can be used for the preparation of the subbing layer in the bowling lane of this invention is preferably one having a hardness (Shore D) of 50 to 85, a tensile strength of 100 kg/cm$^2$ or more, preferably 100 to 400 kg/cm$^2$, an elongation at break of 10% or more, preferably 10 to 120%, and a tear strength of 30% or more, preferably 30 to 150 kg/cm at 25° C. Suitable examples of the epoxy resin include a combination of condensation products of bisphenol A or bisphenol F with epichlorohydrin and a curing agent, e.g., polyamine and/or its modified product.

The epoxy resin may be a resin having been rendered flexible in various manners such as those described in the examples described hereinbelow, and flexible resins which have an elongation at break of 10% or more measured according to the method of JIS K-6301 for its cured product are generally preferred.

Suitable examples of the flexible epoxy resins which can be used in this invention include various types of resins, typically, (1) flexible resins that contain in the main agent an epoxy-containing, flexibility-imparting component such as (i) polyoxyalkylene glycol diglycidyl ether, e.g., EPICLON 705, EPICLON 707 (both manufactured by Dainippon Ink and Chemicals, Inc.), (ii) long chain dibasic acid diglycidyl ester, e.g., OS Resin 101 (manufactured by Okamura Seiyu Co., Ltd.), (iii) bisphenol A alkylene oxide adduct, e.g., EP-4000 (manufactured by Asahi Denka Co., Ltd.), and (iv) urethane-modified epoxy resin, e.g., EPITHAN E-195, EPITHAN E-301 (both manufactured by Dainippon Ink and Chemicals, Inc.), (2) flexible resins that have been rendered flexible with a curing agent such as polyamide, i.e., condensation products of a dimeric acid or dibasic fatty acid with a polyamine, and long chain amine, e.g., polyetheramines and modified aliphatic amines, (3) flexible resins that contain dispersed therein a rubber elastic material, e.g., HYCAR (manufactured by Goodrich Co.), (4) flexible resins which are linear polymers such as KAO MAT SK (manufactured by Kao Co., Ltd.), etc., (5) flexible resins that have been rendered flexible with a plasticizer such as dioctyl phosphate (DOP), dibutyl phosphate (DBP), process oil, etc. Of these, the flexible resins of type (1) above are preferred. The epoxy resins can be mixed with a curing agent which is conventionally used for curing epoxy resins, e.g., polyamines.

The epoxy resins which can be used in this invention are preferably those which are liquid at ambient temperatures. Thixotropic property-imparting agents for adjusting the viscosity of the resin such as fine silica powder, or solvents, defoaming agents or the like additives can be added to the epoxy resins, preferably in an amount of 0.01 to 10% by weight based on the total composition.

The polyurethane resin coated on the epoxy resin is preferably one which has a hardness (Shore D) of 50 to 85, preferably 60 to 85, a tensile strength of 200 or more, preferably 200 to 500 kg/cm$^2$, an elongation at break of 30 or more, preferably 100 to 400%, and a tear strength of 50 or more, preferably 50 to 200 kg/cm, at 25° C., and which has transparency, oil resistance, weatherability, abrasion resistance and impact resistance. Preferably, the resin is composed of 2-component type polyurethane resins comprising an isocyanate component and a polyol component. Needless to say, one component type polyurethane resins can also be used.

The isocyanate component is preferably in the form of an isocyanate group-containing urethane prepolymer. The isocyanate group-containing urethane prepolymer is a reaction product of a polyhydroxyl compound and a polyisocyanate compound. Examples of the polyhydroxyl compound include various polyester polyols and/or polyether polyols which can be used in the preparation of usual urethane compounds.

The term "polyester polyol" referred to herein includes condensation products of a polyhydric alcohol with a polybasic carboxylic acid, condensation products of a hydroxycarboxylic acid with a polyhydric alcohol, and the like. Examples of the polyhydric alcohol include ethylene glycol, propylene glycol, butanediol, diethylene glycol, glycerol, hexanetriol, trimethylolpropane, etc. Examples of the polybasic carboxylic acid include adipic acid, glutaric acid, azelaic acid, fumaric acid, maleic acid, phthalic acid, terephthalic acid, dimeric acid, pyromellitic acid, etc. Also, useful examples of the condensation products of the hydroxycarboxylic acid with the polyhydric alcohol include castor bean oil, reaction products of castor bean oil with ethylene glycol, propylene glycol or the like. Further, lactone-based polyester polyols which can be obtained by the ring opening polymerization of lactones such as ε-caprolactone may be used as the polyester polyol. The lactone based polyester polyols include addition polymerization products obtained by addition polymerizing one or more of ε-caprolactone, δ-valerolactone, β-methyl-δ-valerolactone, etc. with the polyhydric alcohol described above.

Examples of the polyether polyol include addition polymerization products obtained by addition polymerizing one or more of alkylene oxides such as ethylene oxide, propylene oxide, butylene oxide, tetrahydrofuran, etc. with a compound having two or more active hydrogens. Any of the conventional polyether polyols that are used in the preparation of usual polyurethane resins can be used for the purpose. Examples of compounds having two or more active hydrogens include, in addition to the polyhydric alcohols and polybasic carboxylic acids described above, amines such as ethylenediamine and hexamethylenediamine, alkanolamines such as ethanolamine and propanolamine, polyphenols such as resorcin and bisphenol, castor bean oil, etc.

The polyhydroxyl compound may be a mixture of one or more of the polyester polyols and/or polyether polyols and a low molecular weight polyhydroxyl compound such as those described above.

The polyisocyanate compound which can be used in the preparation of the isocyanate group-containing urethane prepolymer is a compound containing two or more isocyanate groups in the molecule. Various compounds that are used in the preparation of usual polyurethane resins can be used as the compound containing two or more isocyanate groups in the molecule. Examples thereof include aromatic polyisocyanate compounds such as tolylene diisocyanate, dianisidine diisocyanate, naphthalene diisocyanate, triphenylmethane triisocyanate, bis(diisocyanatotolyl)phenylmethane, polymethylene polyphenyl polyisocyanate, etc., aliphatic or alicyclic polyisocyanate compounds such as isophorone diisocyanate, dicyclohexylmethane diisocyanate (or hydrogenated diphenylmethane diisocyanate), hexamethylene diisocyanate, xylylene diisocyanate, hydrogenated tolylene diisocyanate and isopropylidenebis(cyclohexyl isocyanate). The aliphatic or alicyclic diisocyanate compounds are preferred because they also prevent yellowing.

The polyisocyanate compounds which can be used in this invention may be employed singly or in combination with each other. Particularly, aromatic polyisocyante compounds can be added to aliphatic or alicyclic polyisocyanate compounds in amounts such that the former does not affect adversely the yellowing resistance of the resulting resin composition.

The isocyanate group-containing urethane prepolymer which can be used in the present invention can be prepared by reacting a polyhydroxyl compound and a polyisocyanate compound in any desired molar ratios as long as the polyhydroxyl compound is in an excess amount. The molar ratio of polyhydroxyl compound/polyisocyanate compound may be selected appropriately, taking into consideration various other conditions such as the compounding ratio, reactivity of the components, etc., and is preferably 1/1.1 or more. When the molar ratio of polyhydroxyl compound/polyisocyanate compound becomes closer to 1/1, the viscosity of the resulting resin becomes too high to process it. On the contrary, when a large excess of an isocyanate compound is used, the molar amount of the polyisocyanate compound per mol of the polyhydroxyl compound is not limited particularly. If desired, the polyisocyanate compound described above may be used as an isocyanate component as it is without converting it into a urethane prepolymer.

Any of the polyhydroxyl compounds described above that can be used for the preparation of the isocyanate group-containing urethane prepolymer are usable as the polyol component in the polyurethane resin. That is, one or more of the polyester polyols and polyether polyols can be used. It is also possible to use low molecular weight polyhydroxyl compounds such as the above-described polyhydric alcohols in combination with the polyester polyols and polyether polyols as the polyol component. Further, a variety of additives such as curing catalysts (e.g., dibutyl tin laurylate and lead octylate), solvents (e.g., xylene, toluene and ethyl acetate), defoaming agents (e.g., a silicone based defoaming agent), various stabilizers (e.g.,, ultraviolet adsorbents and antioxidants), etc. can be added to the isocyanate component or polyol component in an amount of preferably from 0.01 to 5% by weight based on the total composition.

Various conventional wood materials including maple, oak and the like can be used as a construction material of the substrate of the bowling lane.

In this invention, the epoxy resin layer is provided as a subbing layer and its primary object is to seal the wood substrate. If polyurethane resin is coated on the substrate directly without providing the subbing layer thereon, the polyurethane resin foams due to water contained in minute amounts in the wood substrate, resulting in the surface of the bowling lane becoming too uneven to enable playing bowling thereon.

The epoxy resin used as a subbing layer also gets into between elements or members of the lanes to glue them to each other. This gluing or adhesion reinforces the underlying lane and effectively prevents the occurrence of cracks in the coating layer due to rattling or shaking of the lane members (rattling or shaking of the substrate).

Generally, the epoxy resin layer is superior to polyurethane resin layers in tight adhesion to the substrate and therefore, it can also serve as a primer layer. Of course, a separate primer layer may be provided, if desired.

The polyurethane resin layer is provided as a top layer and is coated usually in a thickness of 1 mm or more, preferably 2 to 10 mm. The thickness of the polyurethane resin layer need not always be even all over the entire surface of the lane but it may be varied depending on the position. For example, areas where high impact by falling balls is given are coated thicker than anywhere else. Further, coating with the polyurethane resin may be effected on only selected areas of the lane, for example, the pin deck portion.

Prior to coating of the resin, the surface of the lane is machined and polished to remove fouls and stains to make the surface of the lane smooth. The thickness of resin layer to be coated equals the amount of reduction in the thickness of the lane or lowering of the level of the surface of the lane with respect to the prescribed standard level on the approach portion or zone where players throw a ball.

The epoxy resin for the subbing layer is coated uniformly on the smooth surface of the lane using a rubber applicator or the like. Prior to or after the coating of the epoxy resin, a masking tape or a like restriction or masking means is affixed around the periphery of the area to be coated such that the upper end of the tape is at least as high as the thickness of polyurethane resin to be coated on the epoxy resin layer.

After curing of the epoxy resin, the polyurethane resin is cast into the encircled region. It is preferred to degas the polyurethane resin before casting, more particularly during or after mixing when the resin is of two-part type, using a vacuum pump or other suitable means to remove foams contained in the resin. The degasing step is desirable not only because it completely prevents foaming of the resin while it is curing but also because finishing after the curing gives rise to a very beautiful surface. Preferably, the epoxy resin for subbing is also degased.

The polyurethane resin thus degased is used as a bowling lane repairing agent. It is preferred that the bowling lane repairing agent of this invention has a viscosity of from 1,000 to 3,000 centipoises at 25° C. When the viscosity of the repairing agent is outside the above-described range, it is generally difficult to cast it on a substance or surface to be repaired or the efficiency of coating operation is low.

The bowling lane repairing agent of this invention is cast into the encircled area while smoothing it using a rubber applicator or a like smoothing means.

After curing of the polyurethane resin, the masking means is removed and sanding is effected over the entire surface of the resin layer followed by chamfering the outer periphery thereof.

The polyurethane resin can satisfactorily cope with severe conditions such as impact by falling balls because the resin is particularly high in abrasion resistance and impact resistance.

Further, the resin coating layers used in this invention, i.e., both the epoxy resin layer and the polyurethane resin layer, are excellent in transparency and weatherability (yellowing resistance) and therefore it allows various marks put on the underlying layer or substrate of the lane to be seen clearly.

Generally, waxes or the like are further coated on the polyurethane resin coating so that balls can roll well on the lane. The polyurethane resin layer has high resistance to waxes and prolonged use is assured.

Figure 2:
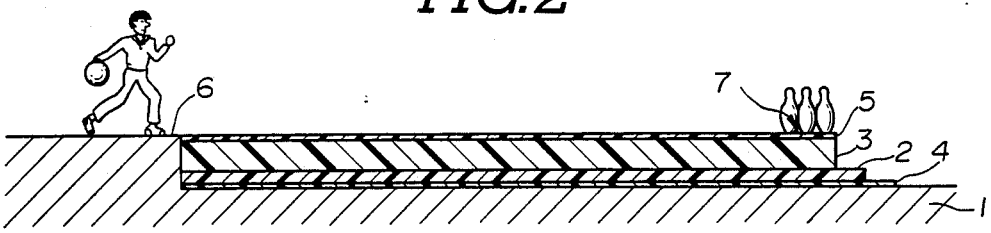

Hereinafter, this invention will be described in greater detail with reference to the attached drawing, in which FIGS. 1 and 2 are schematic cross-sectional views of the bowling lane according to one embodiment of this invention.

In FIGS. 1 and 2, a substrate 1 made of, for example, wood such as maple or oak, is provided by coating on one surface thereof with an epoxy resin layer 2 and a polyurethane resin layer 3, in this order. Upon providing the resin layers 2 and 3 on the substrate 1, a primer layer 4 may be provided between the substrate and the resin layers. Further, a conventional transparent resin lacquer for bowling lanes is also coated on the top of the lane construction to form an uppermost lacquer layer 5. In the drawing, the region between an approach portion or zone 6 where players throw a ball and a pin deck portion or zone 7 where bowling pins stand are made of the bowling lane portion according to the present invention.

Although the resin coated-bowling lane construction of this invention can also be manufactured by affixing or gluing to the substrate one or more plates made of the cured resin having a predetermined size, it is usually manufactured directly in place. Generally, the thickness of the epoxy resin layer is preferably from 0.1 to 0.3 mm, and that of the polyurethane resin layer is preferably from 2 to 10 mm in the finished lane. When a primer layer is used, it is preferred to finish it to have a thickness of from 0.05 to 0.2 mm.

Further, the resin layer may be coated with a conventional transparent resin lacquer for finishing. In this case, the thickness of the lacquer layer 5 is about 0.1 mm. Preferred examples of the lacquer include acrylic resin, acrylic-polyurethane resin, polyurethane resin and the like.

A particularly remarkable effect of this invention is in the transparency, weatherability (yellowing resistance) and impact resistance. Because of their transparency, the coating layers used in this invention enable various marks drawn or painted on the substrate to be seen clearly even if they are coated to a large thickness. Therefore, there is no problem in the discernibility of the marks during play.

No yellowing of the resin layers occurs when exposed to intense illumination for a long period of time in the bowling alley because the resins used have a high weatherability (yellowing resistance) and they retain their initial, excellent transparency observed immediately after manufacture.

With its high impact resistance, the coating layers of the bowling lane of this invention do not suffer the occurrence of cracks or peeling off from the substrate even if balls fall onto the lane by failure or misplaying during an actual, game, for example.

A further advantage of the provision of the coating layers according to this invention is that the polyurethane resin layer shows less variation in hardness depending on the variation in the ambient temperature; in the winter season, the hardness of the resin layer does not become extremely high (i.e., the resin layer does not become extremely hard) and the properties such as the impact resistance of the material are retained as it is in spite of the fact, that the lane is at low temperatures. On the contrary, in the summer season, the hardness of the resin layer is not lowered (i.e., the resin layer does not become soft) and excellent physical properties are retained even though the lane is hot. Substantially, no difference is observed in the manner of rolling of the balls, sound or noise made by balls upon fall and contact with the lane, no matter which season it is, summer or winter. In this respect, too, the resin layers exhibit stable properties.

The effects of the bowling lane construction of this invention are not expected from the conventional bowling lanes, e.g., those with only an epoxy resin coating or those with coating layers made of other materials such as polycarbonate. Thus, excellent bowling lanes are not obtained unless the polyurethane resin layer and the epoxy resin layer described above are provided on the substrate in this order.

The invention will be explained in further detail with reference to examples which should in no way be construed as limiting this invention.

EXAMPLE 1

EPITHAN E-307u, a flexible epoxy resin manufactured by Dainippon Ink and Chemicals, Inc., which contains polyoxyalkylene glycol diglycidyl ether as a flexibility-imparting component, was mixed with Luckamide WH-036S, a curing agent manufactured by Dainippon Ink and Chemicals, Inc. and degased, and the resulting mixture was coated as a subbing layer on the surface of a bowling lane which had been used for about 15 years and were unable to be further subjected to resurfacing in a thickness of about 0.2 mm using a rubber applicator. After allowing to stand at room temperature for one night to cure the epoxy resin in the subbing layer, a masking tape was wound around the outer periphery of the lane in order to prevent the leakage of a polyurethane resin to be cast in the area encircled by the tape. Then, a two-part polyurethane resin was produced by mixing in place two components, i.e., EPITHAN E-310, an isocyanate group-containing urethane prepolymer manufactured by Dainippon Ink and Chemicals, Inc., and EPITHAN C-75, a polyol manufactured by Dainippon Ink and Chemicals, Inc., and degased, followed by casting in the encircled area on the lane substrate so as to form a coating layer of an average thickness of about 5 mm. The pin deck zone and approach zone where particularly high impact resistance is required are coated to have a thickness of about 7 to 10 mm in contrast to central zones of the lane where the thickness of the coating layer is about 2 to 3 mm. After allowing the coating to stand at room temperature to cure the polyurethane resin layer, the masking tape was removed and the lane was sanded all over the surface thereof. U-300 SCORE-COAT, a urethane based varnish manufactured by Periaustin Co. was coated on the polyurethane resin layer as a finishing in a thickness of about 0.05 mm. The cured epoxy resin used as a subbing layer had a hardness (Shore D) of 68, a tensile strength of 255 kg/cm$^2$, an elongation at break of 95%, and a tear strength of 85 kg/cm, at 25° C. The polyurethane resin used as the top layer had a hardness (Shore D) of 72, a tensile strength of 385 kg/cm$^2$, an elongation at break of 170%, and a tear strength of 120 kg/cm, at 25° C. After having actually used the thus-processed lane for playing for one year (about twenty thousands games), the lane showed no yellowing and retained the same transparency as that observed immediately after the renewal processing nor had this lane suffered any cracks in the coating layers or peeling of the coating layers from the substrate.

EXAMPLE 2

In this example, only the pin deck zone, i.e., most damaged portion, of a bowling lane after 10 years' use was coated with a resin layer.

Firstly, PANDEX T-200, a one-part polyurethane based primer manufactured by Dainippon Ink and Chemicals, Inc., was coated on the surface of the lane in a thickness of about 0.05 mm and then, EPITHAN E-307u was coated thereon as a subbing layer in a thickness of about 15 mm in the same manner as in Example 1.

After curing of the epoxy layer, the areas to be coated were encircled with a masking tape, and a composition of EPITHAN E-310/EPITHAN C-75 was cast in the encircled area in a thickness of about 8 mm. After curing, the masking tape was removed and the interface which had been facing the masking tape was chamfered for finishing. The thus-processed lane which had been actually used for playing for about 1 year (after about twenty thousands games) showed no yellowing and retained initial excellent transparency as that observed immediately after the renewal processing. The coating layers showed no cracks therein and did not peel from the substrate.

COMPARATIVE EXAMPLE 1

The same flexible epoxy resin used in Example 1 was cast in the area encircled by a masking tape on the surface of a bowling lane under the same conditions as that used in Example 1 to form a coating in an average thickness of about 5 mm using a rubber applicator. The pin deck zone and approach zone were coated to have a thickness of about 7 to 10 mm in contrast to central zones of the lane which was coated to a thickness of about 2 to 3 mm. After allowing the coating to stand at room temperature for one night to cure the epoxy resin, the masking tape was removed and the lane was sanded all over the surface thereof. U-300 SCORE-COAT, a urethane based varnish manufactured by Periaustin Co. was coated on the polyurethane resin layer as a finishing in a thickness of about 0.05 mm. The cured epoxy resin layer had a hardness (Shore D) of 72, a tensile strength of 260 kg/cm$^2$, an elongation at break of 85%, and a tear strength of 90 kg/cm, at 25° C. Upon actual use for playing, the thus-processed lane showed several cracks near the foul lines within one week (about 400 games). When the use of the lane was further continued as it was 30 or more cracks occurred near the foul lines and around the pin deck zones after 3 months (abut 5000 games). The lane showed yellowing to an extent that the marks on the substrate were difficult to be seen, with the result that games could not be played thereon any more.

COMPARATIVE EXAMPLE 2

The procedures of Example 1 were repeated, except that the polyurethane resin was not subjected to the degasing operation, to form a coating layer in a thickness of 5 mm on the substrate. The thus-obtained lane appeared whiteish with poor transparency because a lot of foams were formed in the polyurethane layer so that the marks on the substrate could not be seen clearly. The impact resistance of the lane was poor because of these foams.

COMPARATIVE EXAMPLE 3

A bowling lane substrate under the same conditions as in Example 1 was coated with the same degased polyurethane resin as used in Example 1 in a thickness of 2 mm. The thus-obtained substrate was further coated with the same epoxy resin as used in Comparative Example 1 in a thickness of 3 mm. Upon actual use for playing, the thus-processed lane not only showed cracks on the surface thereof after 3 months but also exhibited poor impact resistance. Considerable yellowing occurred and the marks on the substrate were hardly discernible through the coating layers. Foams were formed on a part of the polyurethane resin layer which caused cracks to occur in the resin layer and deteriorated the transparency thereof.

While the invention has been particularly shown and described with reference to preferred embodiments thereof it will be understood by those skilled in the art that the foregoing and other changes in form and details can be made therein without departing from the spirit and scope of the invention.

What is claimed is:

1. A bowling lane comprising a substrate having provided thereon a first transparent layer composed of an epoxy resin having a thickness of about 0.1 to 0.3 mm and a second transparent layer composed of a polyurethane resin having a thickness of about 2 to 10 mm in this order, said epoxy resin having a hardness (Shore D) of 50 to 85, and said polyurethane having a hardness (Shore D) of 50 to 85.

2. The bowling lane as claimed in claim 1, wherein said substrate is made of wood.

3. The bowling lane as claimed in claim 1, wherein said epoxy resin has an elongation at break of 10% or more, at 25° C.

4. A bowling lane as claimed in claim 3, wherein said epoxy resin has a tensile strength of 100 to 400 kg/cm$^2$.

5. A bowline lane as claimed in claim 3, wherein said epoxy resin has an elongation at break of 10 to 120%.

6. A bowling lane as claimed in claim 3, wherein said epoxy resin has a tear strength of 30 to 150 kg/cm at 25° C.

7. The bowling lane as claimed in claim 1, wherein said polyurethane resin has a tensile strength of 200 kg/cm$^2$ or more, an elongation at break of 30% or more, and a tear strength of 50 kg/cm or more, at 25° C.

8. The bowling lane as claimed in claim 1, wherein said polyurethane resin comprises a two-part polyurethane composed of an isocyanate component and a polyol component.

9. A bowling lane as claimed in claim 1, further comprising a primer layer between the substrate and the first transparent layer.

10. A bowling lane as claimed in claim 1, further comprising a transparent resin lacquer layer on top of the second transparent layer.

11. A bowling lane as claimed in claim 1, wherein said epoxy resin is a combination of a condensation product of bisphenol A or bisphenol F with epichlorohydrin and a curing agent.

12. A bowling lane as claimed in claim 11, wherein said curing agent is selected from the group consisting of a polyamine and the modified product thereof.

13. A bowling lane as claimed in claim 1, wherein said epoxy resin is a flexible epoxy resin selected from the group consisting of (1) flexible resins containing an epoxy-containing, flexibility-imparting component, (2) flexible resins rendered flexible with a curing agent, (3) flexible resins containing dispersed therein a rubber elastic material, (4) flexible resins that are linear polymers, and (5) flexible resins rendered flexible with a plasticizer.

14. A bowling lane as claimed in claim 13, wherein said flexible epoxy resin is a flexible resin containing an epoxy-containing, flexibility-imparting component.

15. A bowling lane as claimed in claim 14, wherein said epoxy resin is selected from the group consisting of polyoxyalkylene glycol diglycidyl ether, long chain dibasic acid diglycidyl ester, bisphenol A alkylene oxide adduct, and urethane-modified epoxy resin.

16. A bowling lane as claimed in claim 1, wherein polyurethane resin is composed of a two-component type polyurethane resin comprising an isocyanate component and a polyol component and wherein said isocyanate component is in the form of an isocyanate group-containing urethane prepolymer.

17. A bowling lane as claimed in claim 16, wherein said isocyanate group-containing urethane prepolymer is the reaction product of a polyhydroxyl compound and a polyisocyanate compound.

18. A bowling lane as claimed in claim 17, wherein said polyhydroxyl compound is selected from the group consisting of a polyester polyol and a polyether polyol.

19. A bowling lane as claimed in claim 18, wherein said polyesther polyol is at least one member selected from the group consisting of the condensation product of a polyhydric alcohol with a polybasic carboxylic acid, the condensation product of a hydroxycarboxylic acid with a polyhydric alcohol, and lactone-based polyester polyols.

20. A bowling lane as claimed in claim 18, wherein said polyether polyol is an addition polymerization product obtained by polymerizing one or more alkylene oxides with a compound having two or more active hydrogens.

21. A bowling lane as claimed in claim 20, wherein said compound having two or more active hydrogens is selected from the group consisting of polyhydric alcohols, polybasic carboxylic acids, amines, alkanolamines, and polyphenols.

22. A bowling lane as claimed in claim 17, wherein said polyisocyanate compound is selected from the group consisting of aromatic polyisocyanate compounds, aliphatic polyisocyanate compounds and alicyclic polyisocyanate compounds.

23. A bowling lane as claimed in claim 22, wherein said polyisocyanate compound is selected from the group consisting of aliphatic polyisocyanate compounds and alicyclic polyisocyanate compounds.

* * * * *